US007899356B2

(12) United States Patent
Mori et al.

(10) Patent No.: US 7,899,356 B2
(45) Date of Patent: Mar. 1, 2011

(54) DEVELOPING DEVICE, IMAGE CARRIER DEVICE, AND IMAGE FORMING APPARATUS

(75) Inventors: Hiroki Mori, Nagoya (JP); Mitsuru Horinoe, Aichi-ken (JP); Yuichi Matsushita, Nagoya (JP); Yukiko Nakaya, Konan (JP); Fan Xu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 684 days.

(21) Appl. No.: 11/846,913

(22) Filed: Aug. 29, 2007

(65) Prior Publication Data

US 2008/0056774 A1 Mar. 6, 2008

(30) Foreign Application Priority Data

Aug. 31, 2006 (JP) ..... P2006-235009

(51) Int. Cl.
*G03G 15/08* (2006.01)

(52) U.S. Cl. ..... 399/103; 399/102; 399/107

(58) Field of Classification Search ..... 399/103, 399/111, 119, 102, 117
See application file for complete search history.

(56) References Cited

U.S. PATENT DOCUMENTS

2005/0158070 A1 7/2005 Ishii
2006/0291895 A1* 12/2006 Fukuta et al. ..... 399/103
2007/0248376 A1 10/2007 Mori et al.

FOREIGN PATENT DOCUMENTS

JP 2005189346 7/2005
JP 2007-292876 A 11/2007

* cited by examiner

*Primary Examiner*—David P Porta
*Assistant Examiner*—Yara B Green
(74) *Attorney, Agent, or Firm*—Banner & Witcoff, Ltd.

(57) ABSTRACT

A layer-thickness regulating member includes a thin plate member and a projection member provided on a free edge portion of the thin plate member. A leak preventing members include a first seal member and a second seal member. The first seal member includes a first downstream portion disposed adjacent to the projection member on a front surface of the thin plate member, and a first upstream portion extending upstream of the first downstream portion. The second seal member includes a second downstream portion, and a second upstream portion which extends upstream of the second downstream portion. The second upstream portion includes a covered portion covered with the first upstream portion, an opposed portion disposed adjacent to the covered portion and opposed to the adjacent portion of the projection member and an exposed portion extending upstream of the covered portion and the opposed portion.

9 Claims, 10 Drawing Sheets

151

DEVELOPING DEVICE, IMAGE CARRIER DEVICE, AND IMAGE FORMING APPARATUS

CROSS REFERENCE TO THE RELATED APPLICATION

This application claims priority to Japanese Patent Application No. 2006-235009 filed on Aug. 31, 2006, the disclosure of which is hereby incorporated into the present application by reference.

TECHNICAL FIELD

The present invention relates to an image forming apparatus such as a laser printer, and a developing device such as a developer cartridge and an image carrier device such as a drum unit to be mounted in the image forming apparatus.

BACKGROUND

In an image forming apparatus such as a laser printer, an electrostatic latent image is formed on a surface of a photosensitive drum, and toner is supplied to the electrostatic latent image from a developer cartridge, whereby a toner image is carried on the surface of the photosensitive drum. Then, the toner image is transferred onto a sheet. Thus, an image is formed on the sheet.

The developer cartridge includes a casing which contains toner and has an opening facing toward the photosensitive drum. The developer cartridge further includes a developing roller rotatably provided in the casing as being exposed from the opening of the casing, a layer-thickness regulating blade provided in the casing for regulating the thickness of a toner layer carried on the developing roller, and seal members provided in the casing for preventing the toner from leaking from axially opposite end portions of the developing roller.

Referring to FIG. 11, a developer cartridge 151 is illustrated as such a developer cartridge.

In FIG. 11, the developer cartridge 151 includes a casing 152 having an opening 153 extending longitudinally thereof, and a layer-thickness regulating blade 154 provided in the opening 153 of the casing 152 as extending longitudinally of the opening 153.

The layer-thickness regulating blade 154 includes a blade 155 and a pressure contact rubber 156. The blade 155 is of a thin plate shape, and has a fixed downstream edge portion (an upper edge portion in FIG. 11) on a downstream side with respect to the direction of the rotation of the developing roller 160 (see FIG. 12). The pressure contact rubber 156 is provided on a free upstream edge portion (a lower edge portion in FIG. 11) of the blade 155 on an upstream side with respect to the rotation direction of the developing roller 160 as extending to the vicinities of longitudinally opposite end portions of the blade 155.

Further, seal members 157 are respectively provided on longitudinally opposite end portions of the opening 153. The seal members 157 are disposed along the rotation direction of the developing roller 160. Downstream end portions 158 of the seal members 157 located downstream with respect to the rotation direction of the developing roller 160 are respectively attached to surfaces of the longitudinally opposite end portions of the blade 155 in adjoining relation to longitudinally opposite ends of the pressure contact rubber 156. Further, upstream end portions 159 of the seal members 157 located upstream with respect to the rotation direction of the developing roller 160 are respectively attached to surfaces of end portions of the casing 152.

In the developer cartridge shown in FIG. 11, therefore, the developing roller 160 is kept in pressure contact with surfaces of the aforementioned seal members 157 as shown in FIG. 12. When the developing roller 160 is rotated in an arrow direction in a developing process, the toner is disadvantageously liable to leak through boundary portions 161 between the seal members 157 and the pressure contact rubber 156 in the rotation direction of the developing roller 160 as shown in FIG. 11.

SUMMARY

One aspect of the present invention may provide a developing device which is capable of effectively preventing a developing agent from leaking through a boundary portion between a leak preventing member and a layer-thickness regulating member with a simple construction, and to provide an image carrier device and an image forming apparatus including such a developing device.

The same or different aspect of the present invention may provide a developing device including: a casing which contains a developing agent and has an opening extending longitudinally thereof; a developing agent carrier rotatably provided in the casing as being exposed from the opening and carrying the developing agent; leak preventing members disposed at longitudinally opposite ends of the opening for preventing the developing agent from leaking out of the casing; and a layer-thickness regulating member kept in pressure contact with a surface of the developing agent carrier for forming a thin layer of the developing agent on the surface of the developing agent carrier; wherein the layer-thickness regulating member includes a thin plate member having a thin plate shape extending longitudinally of the casing to positions such as to overlap with the leak preventing members, and having a downstream edge portion fixed to the casing with respect to a direction of rotation of the developing agent carrier that is the same direction as a direction perpendicular to a longitudinal direction of the casing and a free upstream edge portion with respect to the rotation direction, and a projection member provided on the free edge portion of the thin plate member as extending longitudinally of the casing and projecting toward the developing agent carrier; wherein the leak preventing members each include a first seal member and a second seal member each disposed along the rotation direction; wherein the first seal member includes a first downstream portion disposed adjacent, longitudinally of the casing, to the projection member on a front surface of the thin plate member opposed to the developing agent carrier, and a first upstream portion extending upstream of the first downstream portion with respect to the rotation direction continuously from the first downstream portion; wherein the second seal member includes a second downstream portion disposed on a rear surface of the thin plate member facing away from the developing agent carrier, and opposed to the first downstream portion and a portion of the projection member adjacent to the first downstream portion with intervention of the thin plate member, and a second upstream portion which extends upstream of the second downstream portion with respect to the rotation direction continuously from the second downstream portion and integrally includes a covered portion covered with the first upstream portion, an opposed portion disposed adjacent, longitudinally of the casing, to the covered portion and opposed to the adjacent portion of the projection member in the rotation direction, and an exposed portion extending upstream of the covered portion and the opposed portion with respect to the rotation direction.

One or more aspects of the present invention provide an image carrier device including: a developing device; and an image carrier which carries a developing agent image formed thereon by supplying a developing agent thereto from the developing device and developing an electrostatic latent image with the developing agent; wherein the developing device includes a casing which contains the developing agent to be supplied to the image carrier and has an opening extending longitudinally thereof, a developing agent carrier rotatably provided in the casing as being exposed from the opening and carrying the developing agent to be supplied to the image carrier, leak preventing members disposed at longitudinally opposite ends of the opening for preventing the developing agent from leaking out of the casing, and a layer-thickness regulating member kept in pressure contact with a surface of the developing agent carrier for forming a thin layer of the developing agent on the surface of the developing agent carrier; wherein the layer-thickness regulating member includes a thin plate member having a thin plate shape extending longitudinally of the casing to positions such as to overlap with the leak preventing members, and having a downstream edge portion fixed to the casing with respect to a direction of rotation of the developing agent carrier that is the same direction as a direction perpendicular to a longitudinal direction of the casing and a free upstream edge portion with respect to the rotation direction, and a projection member provided on the free edge portion of the thin plate member as extending longitudinally of the casing and projecting toward the developing agent carrier; wherein the leak preventing members each include a first seal member and a second seal member each disposed along the rotation direction; wherein the first seal member includes a first downstream portion disposed adjacent, longitudinally of the casing, to the projection member on a front surface of the thin plate member opposed to the developing agent carrier, and a first upstream portion extending upstream of the first downstream portion with respect to the rotation direction continuously from the first downstream portion; wherein the second seal member includes a second downstream portion disposed on a rear surface of the thin plate member facing away from the developing agent carrier, and opposed to the first downstream portion and a portion of the projection member adjacent to the first downstream portion with intervention of the thin plate member, and a second upstream portion which extends upstream of the second downstream portion with respect to the rotation direction continuously from the second downstream portion and integrally includes a covered portion covered with the first upstream portion, an opposed portion disposed adjacent, longitudinally of the casing, to the covered portion and opposed to the adjacent portion of the projection member in the rotation direction, and an exposed portion extending upstream of the covered portion and the opposed portion with respect to the rotation direction.

One or more aspects of the present invention provide an image forming apparatus including: an image carrier device; and a fixing unit which fixes a developing agent image carried by the image carrier device on a recording medium; wherein the image carrier device includes a developing device and an image carrier which carries a developing agent image formed thereon by supplying a developing agent thereto from the developing device and developing an electrostatic latent image with the developing agent; wherein the developing device includes a casing which contains the developing agent to be supplied to the image carrier and has an opening extending longitudinally thereof, a developing agent carrier rotatably provided in the casing as being exposed from the opening and carrying the developing agent to be supplied to the image carrier, leak preventing members disposed at longitudinally opposite ends of the opening for preventing the developing agent from leaking out of the casing, and a layer-thickness regulating member kept in pressure contact with a surface of the developing agent carrier for forming a thin layer of the developing agent on the surface of the developing agent carrier; wherein the layer-thickness regulating member includes a thin plate member having a thin plate shape extending longitudinally of the casing to positions such as to overlap with the leak preventing members, and having a downstream edge portion fixed to the casing with respect to a direction of rotation of the developing agent carrier that is the same direction as a direction perpendicular to a longitudinal direction of the casing and a free upstream edge portion with respect to the rotation direction, and a projection member provided on the free edge portion of the thin plate member as extending longitudinally of the casing and projecting toward the developing agent carrier; wherein the leak preventing members each include a first seal member and a second seal member each disposed along the rotation direction; wherein the first seal member includes a first downstream portion disposed adjacent, longitudinally of the casing, to the projection member on a front surface of the thin plate member opposed to the developing agent carrier, and a first upstream portion extending upstream of the first downstream portion with respect to the rotation direction continuously from the first downstream portion; wherein the second seal member includes a second downstream portion disposed on a rear surface of the thin plate member facing away from the developing agent carrier, and opposed to the first downstream portion and a portion of the projection member adjacent to the first downstream portion with intervention of the thin plate member, and a second upstream portion which extends upstream of the second downstream portion with respect to the rotation direction continuously from the second downstream portion and integrally includes a covered portion covered with the first upstream portion, an opposed portion disposed adjacent, longitudinally of the casing, to the covered portion and opposed to the adjacent portion of the projection member in the rotation direction, and an exposed portion extending upstream of the covered portion and the opposed portion with respect to the rotation direction.

One or more aspects of the present invention provide an image forming apparatus including: a developing device; an image carrier which carries a developing agent image formed thereon by supplying a developing agent thereto from the developing device and developing an electrostatic latent image with the developing agent; and a fixing unit which fixes the developing agent image carried by the image carrier on a recording medium; wherein the developing device includes a casing which contains the developing agent to be supplied to the image carrier and has an opening extending longitudinally thereof, a developing agent carrier rotatably provided in the casing as being exposed from the opening and carrying the developing agent to be supplied to the image carrier, leak preventing members disposed at longitudinally opposite ends of the opening for preventing the developing agent from leaking out of the casing, and a layer-thickness regulating member kept in pressure contact with a surface of the developing agent carrier for forming a thin layer of the developing agent on the surface of the developing agent carrier; wherein the layer-thickness regulating member includes a thin plate member having a thin plate shape extending longitudinally of the casing to positions such as to overlap with the leak preventing members, and having a downstream edge portion fixed to the casing with respect to a direction of rotation of the developing agent carrier that is the same direction as a direction perpendicular to a longitudinal direction of the casing and a free upstream edge portion with respect to the rotation direction, and a projection member provided on the free edge portion of the thin plate member as extending longitudinally of the casing and projecting toward the developing agent carrier; wherein the leak preventing members each include a first seal member and a second seal member each disposed along the rotation direction; wherein the first seal member includes a first downstream portion disposed adjacent, longitudinally of the casing, to the projection member on a front surface of the thin plate member opposed to the developing agent carrier, and a first upstream portion extending upstream of the first downstream portion with respect to the rotation direction continuously from the first downstream portion; wherein the second seal member includes a second downstream portion disposed on a rear surface of the thin plate member facing away from the developing agent carrier, and opposed to the first downstream portion and a portion of the projection member adjacent to the first downstream portion with intervention of the thin plate member, and a second upstream portion which extends upstream of the second downstream portion with respect to the rotation direction continuously from the second downstream portion and integrally includes a covered portion covered with the first upstream portion, an opposed portion disposed adjacent, longitudinally of the casing, to the covered portion and opposed to the adjacent portion of the projection member in the rotation direction, and an exposed portion extending upstream of the covered portion and the opposed portion with respect to the rotation direction.

DETAILED DESCRIPTION

Embodiments of the present invention will hereinafter be described with reference to the attached drawings.

First Embodiment

1. Overall Structure of Color Laser Printer

Figure 1:
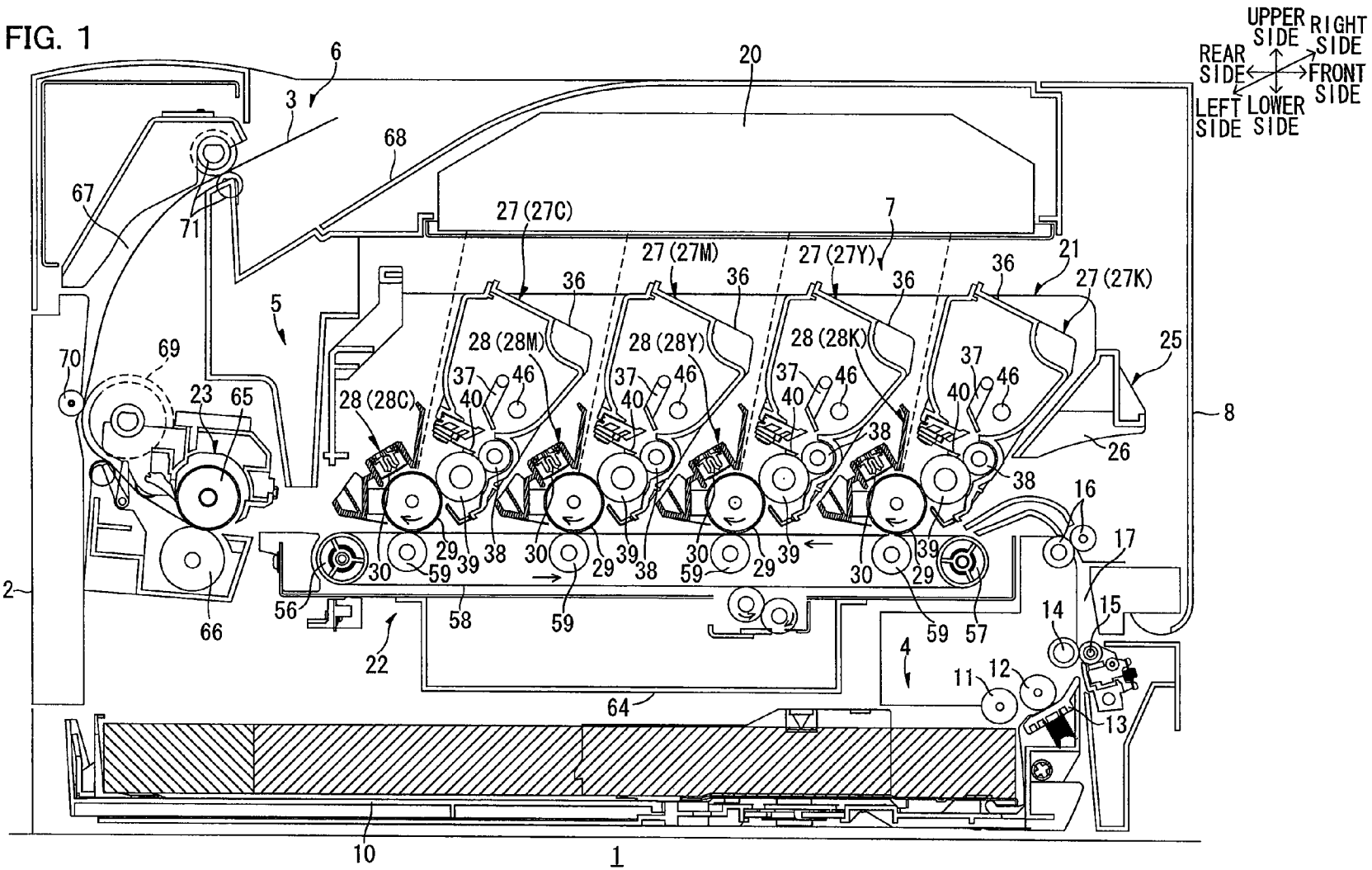
FIG. 1 is a side sectional view illustrating one embodiment of a color laser printer as an image forming apparatus of one or more aspects of the present invention.
Figure 2:
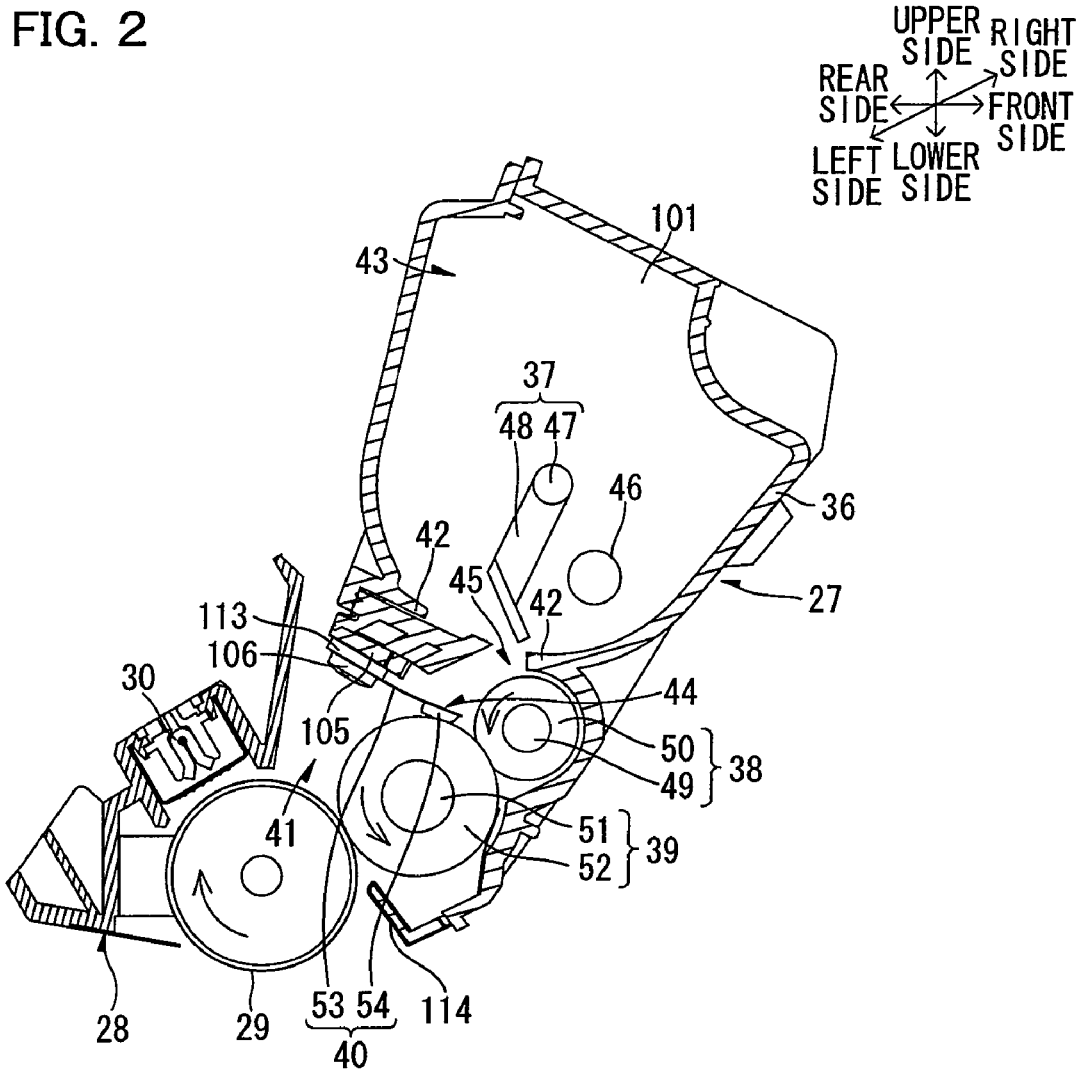
FIG. 2 is a sectional view of a drum subunit of the color laser printer shown in FIG. 1.

FIG. 1 is a side sectional view illustrating one embodiment of a color laser printer as an image forming apparatus of the present invention, and FIG. 2 is a sectional view of a drum subunit of the color laser printer shown in FIG. 1.

The color laser printer 1 is a tandem color laser printer of a horizontal type, in which a plurality of drum subunits 28 to be described later are horizontally arranged.

The color laser printer 1 includes a sheet feeding section 4 for feeding a sheet 3 as an example of recording medium, an image forming section 5 for forming an image on the fed sheet 3, and a sheet ejecting section 6 for ejecting the sheet 3 formed with the image, and these sections are provided in a main body casing 2 of the printer 1.

(1) Main Body Casing

The main body casing 2 is of a box shape generally rectangular as seen from a lateral side, and has a drum receiving space 7 which accommodates a drum unit 25 as an example of image carrier device to be described later.

A front cover 8 is provided on one side of the main body casing 2. With the front cover 8 being inclined outward, the drum receiving space 7 is opened, so that the drum unit 25 is detachably mountable in the drum receiving space 7. With the front cover 8 being set upright, the drum receiving space 7 is closed, in which the drum unit 25 is accommodated.

In the following description, a side of the color laser printer 1 provided with the front cover 8 (right-hand side in FIG. 1) is defined as a front side (forward side), and a side of the color laser printer 1 opposite from the front side (left-hand side in FIG. 1) is defined as a rear side (rearward side).

Further, left and right sides of the color laser printer 1 are defined as seen from the front side of the printer 1. That is, a front side of the paper face of FIG. 1 is defined as the left side of the printer 1, and a rear side of the paper face of FIG. 1 is defined as the right side of the printer 1. Further, it is herein defined that leftward and rightward directions are equivalent to transverse directions.

Directions to be herein used for explaining the drum unit 25 and developer cartridges 27 are based on the assumption that the drum unit 25 and the developer cartridges 27 are mounted in the main body casing 2, unless otherwise specified.

(2) Sheet Feeding Section

The sheet feeding section 4 includes a sheet feeding tray 10 detachably mounted in a bottom portion of the main body casing 2, a sheet feeding roller 11 disposed on an upper front side of the sheet feeding tray 10, and a sheet feeding path 17 extending from the sheet feeding roller 11 to a transport belt 58 to be described later.

A separation roller 12 and a separation pad 13, a sheet dust removing roller 14 and a pinch roller 15, and registration rollers 16 are provided in the sheet feeding path 17.

Sheets 3 which are stacked in the sheet feeding tray 10 are fed by rotation of the sheet feeding roller 11, and separated one from another between the separation roller 12 and the separation pad 13. Then, the sheet 3 is transported to the registration rollers 16 after paper dust and the like are removed from the sheet 3 between the sheet dust removing roller 14 and the pinch roller 15. The registration rollers 16 once stop the sheet 3 for registration, and then transport the sheet 3 to the transport belt 58 (to be described later).

(3) Image Forming Section

The image forming section 5 includes a scanning section 20, a processing section 21, a transferring section 22 and a fixing section 23 as an example of fixing unit.

(3-1) Scanning Section

The scanning section 20 is disposed in an upper portion of the main body casing 2. Optical elements such as a light source, mirrors and lenses are provided in the scanning section 20. Based on image data, surfaces of photosensitive drums 29 as an example of image carrier for respective colors to be described later are irradiated to be scanned at a high speed with a laser beam emitted from the light source by the mirrors and the lenses.

(3-2) Processing Section

The processing section 21 is disposed below the scanning section 20 above the sheet feeding section 4. The processing section 21 includes a single drum unit 25 and four developer cartridges 27 (developing device) for the respective colors.

(3-2-1) Drum Unit

The drum unit 25 includes four drum subunits 28 for the respective colors, and a drawer frame 26 in which the drum subunits 28 are provided.

The four drum subunits 28 include a black drum subunit 28K, a yellow drum subunit 28Y, a magenta drum subunit 28M and a cyan drum subunit 28C. The drum subunits 28 are arranged in tandem in anteroposteriorly spaced relation.

All the drum subunits 28 are fixed to the drawer frame 26, and unitarily mounted in and demounted from the drum receiving space 7.

As shown in FIG. 2, the drum subunits 28 each support a photosensitive drum 29 as an example of image carrier, a scorotron charger 30 and a cleaning brush 31.

The photosensitive drum 29 is of a hollow cylindrical shape, and includes a positively chargeable photosensitive outermost layer of polycarbonate. The photosensitive drum 29 is rotated by a driving force transmitted from a motor (not shown) provided in the main body casing 2 during an image forming process.

The scorotron charger 30 is disposed in opposed spaced relation to the photosensitive drum 29. During the image forming process, a high voltage is applied to the scorotron charger 30, whereby the surface of the photosensitive drum 29 is uniformly positively charged.

(3-2-2) Developer Cartridges

As shown in FIG. 1, the developer cartridges 27 are respectively provided in the drum subunits 28 for the respective colors in a detachable manner.

That is, the four developer cartridges 27 include a black developer cartridge 27K, a yellow developer cartridge 27Y, a magenta developer cartridge 27M and a cyan developer cartridge 27C.

As shown in FIG. 2, the developer cartridges 27 each include a developer frame 36 as an example of casing, and an agitator 37, a feed roller 38, a developing roller 39 as an example of developing agent carrier and a layer-thickness regulating blade 40 as an example of layer-thickness regulating member, which are provided in the developer frame 36.

As will be detailed later, the developer frame 36 is of a box shape, and has an opening 41 provided in a lower portion thereof. The developer frame 36 is partitioned into an upper toner accommodating chamber 43 and a lower developing chamber 44 by a partition wall 42. The partition wall 42 has a communication port 45 which permits communication between the toner accommodating chamber 43 and the developing chamber 44.

The toner accommodating chamber 43 contains toner as an example of developing agent for each color. A positively chargeable nonmagnetic single-component polymer toner in which a black, yellow, magenta or cyan colorant is blended is used as the color toner.

The toner preferably has an average particle diameter (average primary particle diameter) of not greater than 10 μm, more preferably not greater than 8 μm, and usually not smaller than 6 μm, as determined by Coulter Multicizer II available from Beckman Coulter Incorporated. The toner preferably has a sphericity of not less than 0.95, more preferably not less than 0.98, as determined by FPIA3000 available from Sysmex Corporation.

Pulverization toner may be used instead of the polymer toner, as long as the average particle diameter or the sphericity described above is satisfied.

The toner accommodating chamber 43 has detection windows 46 provided in opposite side walls 101 of the developer frame 36 (see FIG. 3) as being opposed transversely to each other for detecting the amount of toner remaining in the toner accommodating chamber 43.

The agitator 37 is provided in the toner accommodating chamber 43. The agitator 37 includes an agitator rotating shaft 47 rotatably supported by the opposite side walls 101 of the developer frame 36, and an agitating member 48 extending radially outward from the agitator rotating shaft 47.

During the image forming process, a driving force is transmitted to the agitator rotating shaft 47 from a motor (not shown) provided in the main body casing 2, whereby the agitating member 48 is circularly moved in the toner accommodating chamber 43.

The feed roller 38 is disposed below the communication port 45 in the developing chamber 44. The feed roller 38 includes a feed roller shaft 49 of a metal rotatably supported by the opposite side walls 101 of the developer frame 36, and a sponge roller 50 of an electrically conductive sponge covering the feed roller shaft 49.

During the image forming process, the feed roller 38 is rotated by a driving force transmitted thereto from a motor (not shown) provided in the main body casing 2.

The developing roller 39 is disposed on an obliquely lower rearward side of the feed roller 38 in the developing chamber 44. The developing roller 39 is exposed downward from the opening 41 of the developing chamber 44. The developing roller 39 includes a developing roller shaft 51 of a metal rotatably supported by the opposite side walls 101 of the developer frame 36, and a rubber roller 52 of an electrically conductive rubber covering the developing roller shaft 51.

Further, the developing roller 39 is opposed to the feed roller 38 with the rubber roller 52 kept in pressure contact with the sponge roller 50.

During the image forming process, the developing roller 39 is rotated by a driving force transmitted thereto from a motor (not shown) provided in the main body casing 2. Further, a developing bias is applied to the developing roller 39.

The layer-thickness regulating blade 40 is kept in pressure contact with the developing roller 39 from above in the developing chamber 44. The layer-thickness regulating blade 40 includes a blade 53 as an example of thin plate member of a metal leaf spring having a thin plate shape, and a pressure contact rubber 54 as an example of projection member formed of an insulative elastic rubber provided on a free edge portion of the blade 53.

A proximal edge portion (fixed edge portion) of the blade 53 is fixed to a fixing wall 105 (to be described later) by fixing screws 106 (to be described later), and the pressure contact rubber 54 provided on the free edge portion of the blade 53 is kept in pressure contact with the rubber roller 52 of the developing roller 39 from above by an elastic force of the blade 53.

(3-2-3) Developing Operation in Processing Section

In each of the developer cartridges 27, the corresponding color toner contained in the toner accommodating chamber 43 is agitated by the agitator 37 to be moved toward the communication port 45, and discharged from the communication port 45 into the developing chamber 44.

The toner discharged from the communication port 45 into the developing chamber 44 is fed to the feed roller 38. The toner fed to the feed roller 38 is further fed to the developing roller 39 by rotation of the feed roller 38. At this time, the toner is triboelectrically positively charged between the feed roller 38 and the developing roller 39 to which the developing bias is applied.

The toner fed to the developing roller 39 enters a boundary portion between the pressure contact rubber 54 of the layer-thickness regulating blade 40 and the rubber roller 52 of the developing roller 39 by rotation of the developing roller 39, and is carried in the form of a thin layer having a predetermined thickness on a surface of the rubber roller 52.

On the other hand, the scorotron charger 30 causes corona discharge in the drum subunit 28 provided in association with the developer cartridge 27, whereby the surface of the photosensitive drum 29 is uniformly positively charged.

After the surface of the photosensitive drum 29 is uniformly positively charged by the scorotron charger 30 with the photosensitive drum 29 being rotated, the surface of the photosensitive drum 29 is scanned at a high-speed to be exposed to the laser beam (indicated by a broken line in FIG. 1) from the scanning section 20 as shown in FIG. 1, whereby an electrostatic latent image corresponding to an image to be formed on a sheet 3 is formed on the surface of the photosensitive drum 29.

While the photosensitive drum 29 is further rotated, the toner positively charged on the surface of the developing roller 39 is brought into contact with the photosensitive drum 29 by the rotation of the developing roller 39. At this time, the toner is applied onto the electrostatic latent image formed on the surface of the photosensitive drum 29, i.e., onto a portion of the surface of the photosensitive drum 29 which has been uniformly positively charged and exposed to the laser beam thereby having a reduced potential. Thus, the electrostatic latent image on the photosensitive drum 29 is developed to be made visible, whereby a toner image (developing agent image) of the corresponding color is carried on the surface of the photosensitive drum 29 by reversal development.

(3-3) Transferring Section

The transferring section 22 is anteroposteriorly disposed above the sheet feeding section 4 below the processing section 21 in the main body casing 2. The transferring section 22 includes a driving roller 56, a driven roller 57, the transport belt 58 and transfer rollers 59.

The driving roller 56 and the driven roller 57 are disposed in anteroposteriorly opposed spaced relation. The driving roller 56 is disposed rearward of the cyan drum subunit 28C, and the driven roller 57 is disposed forward of the black drum subunit 28K.

The transport belt 58 is an endless belt, which is stretched between the driving roller 56 and the driven roller 57.

During the image forming process, the driving roller 56 is rotated by a driving force transmitted thereto from a motor (not shown) provided in the main body casing 2. Then, the transport belt 58 is circularly moved between the driving roller 56 and the driven roller 57 in the same direction as the directions of the rotation of the photosensitive drums 29 at transfer positions at which the transport belt 58 contacts the photosensitive drums 29 in opposed relation. Further, the driven roller 57 is driven by the transport belt 58.

The transfer rollers 59 are respectively disposed in opposed relation to the photosensitive drums 29 with the intervention of the transport belt 58 in a space surrounded by the transport belt 58 stretched between the driving roller 56 and the driven roller 57.

The transfer rollers 59 are driven to be rotated in the same direction as the direction of the circular movement of the transfer belt 58 at the transfer positions at which the transfer rollers 59 contact the transport belt 58 in opposed relation. During the image forming process, a transfer bias is applied to the transfer rollers 59.

The sheet 3 fed from the sheet feeding section 4 is transported from the front side to the rear side by the transport belt 58 circularly moved by the driving roller 56 and the driven roller 57, thereby passing through the transfer positions associated with the respective photosensitive drums 29. During the transportation of the sheet 3, the color toner images respectively carried on the photosensitive drums 29 are successively transferred onto the sheet 3, whereby a color image is formed on the sheet 3.

(3-4) Fixing Section

The fixing section 23 is disposed behind the transferring section 22, and includes a heating roller 65 and a pressure roller 66 which is pressed against the heating roller 65.

While the sheet 3 passes through a nip between the heating roller 65 and the pressure roller 66 in the fixing section 23, the color image transferred onto the sheet 3 is thermally fixed on the sheet 3 by application of heat and pressure.

(4) Sheet Ejecting Section

The sheet ejecting section 6 includes a sheet ejecting transport path 67, a transport roller 69, a pinch roller 70, a pair of sheet ejecting rollers 71 and a sheet ejection tray 68.

The sheet 3 transported from the fixing section 23 is further transported through the sheet ejecting transport path 67 by the transport roller 69 and the pinch roller 70, and ejected onto the sheet ejection tray 68 by the sheet ejecting rollers 71.

2. Major Construction of Developer Cartridge

Figure 3:
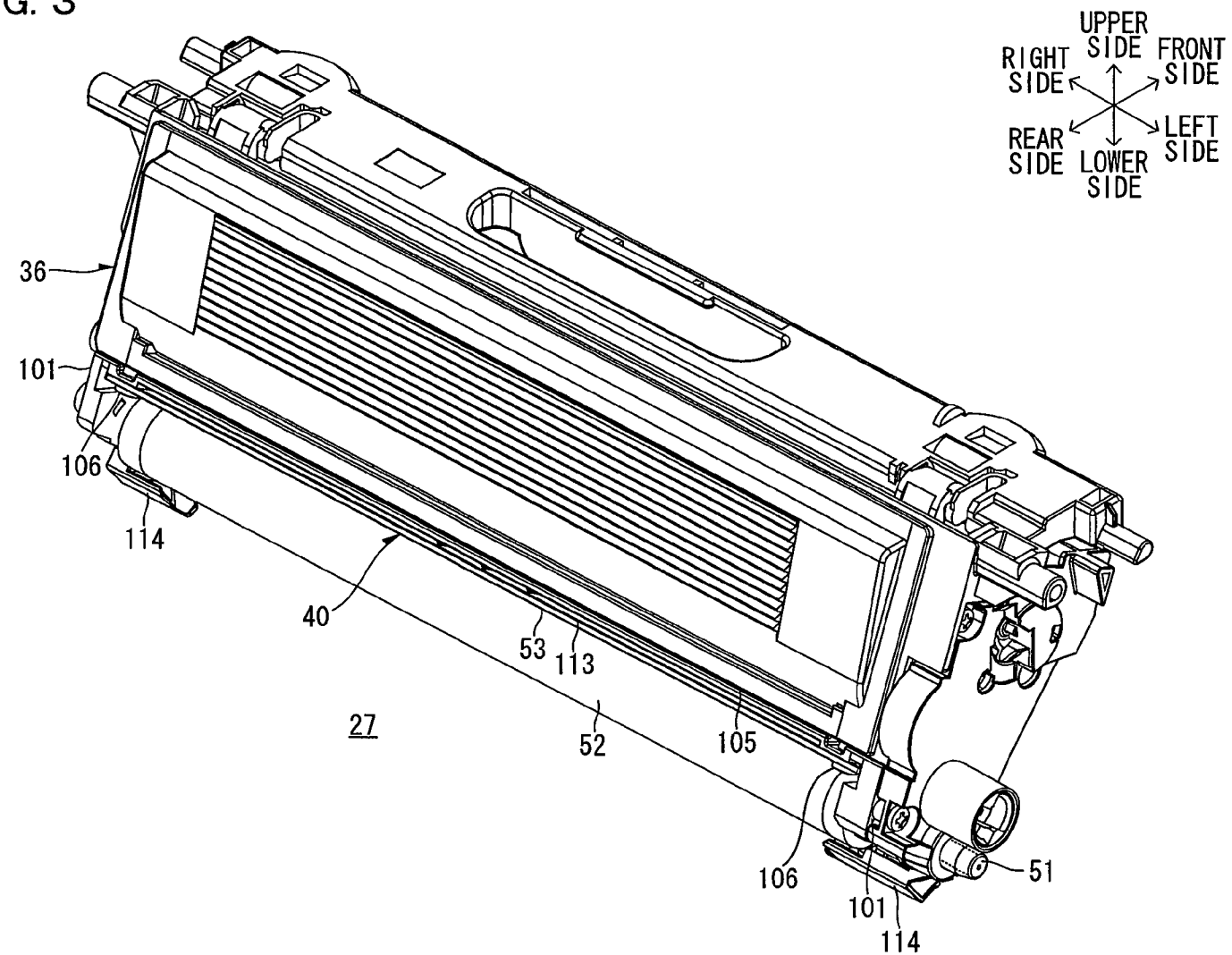
FIG. 3 is a perspective view of a developer cartridge.
Figure 4:
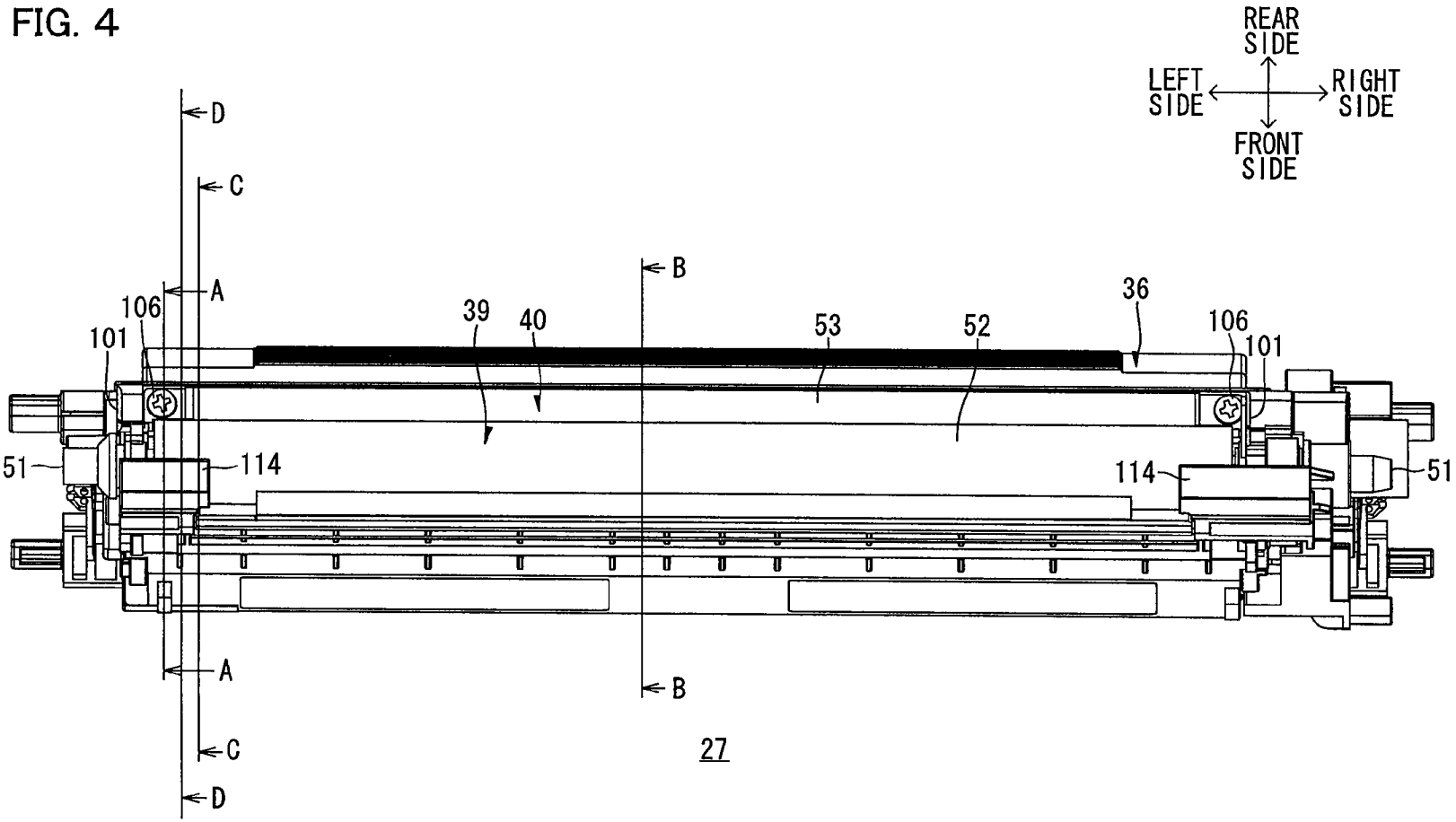
FIG. 4 is a bottom view of the developer cartridge (with a developing roller attached thereto).
Figure 5:
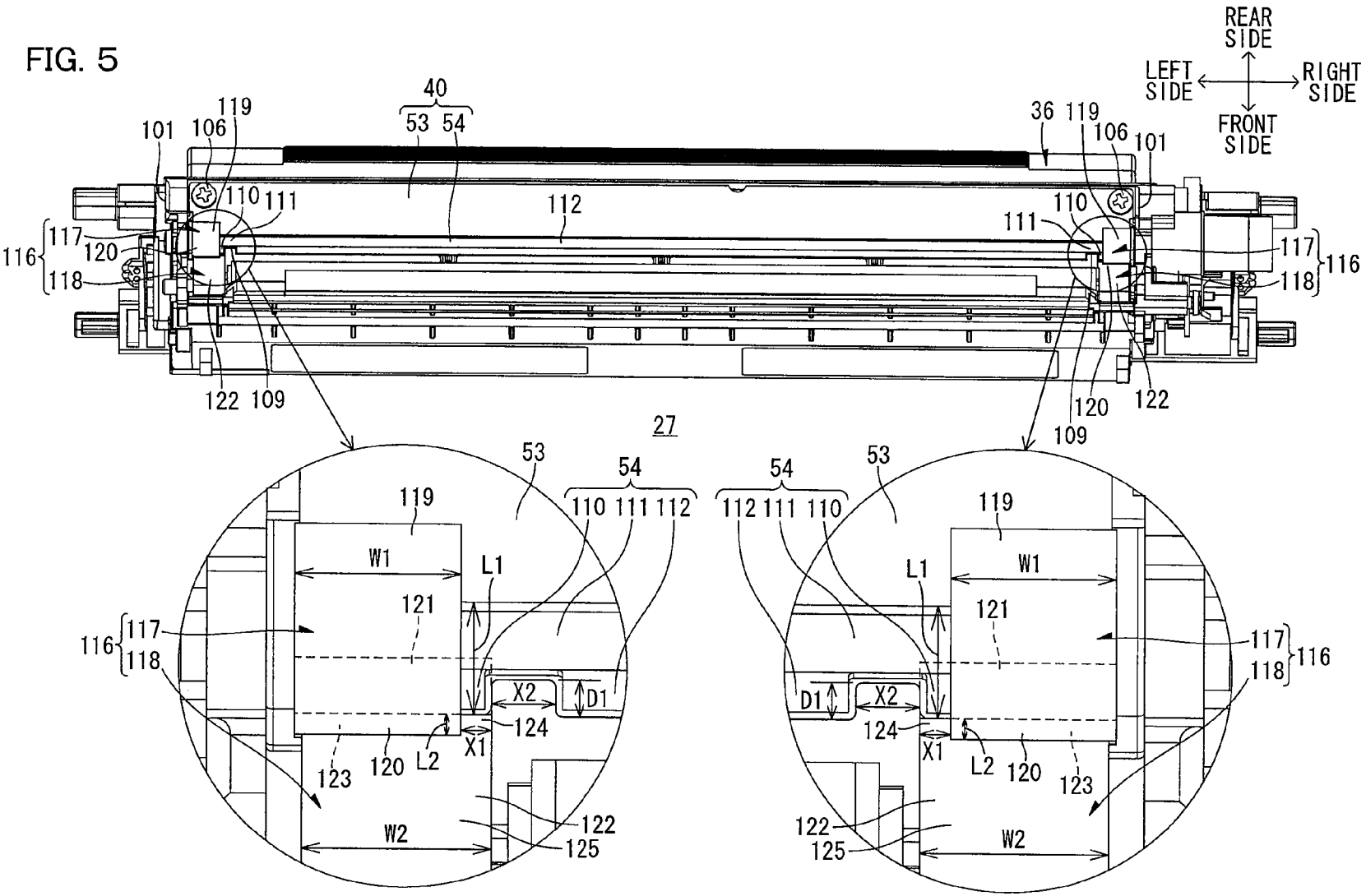
FIG. 5 is a bottom view of the developer cartridge (with the developing roller removed therefrom).
Figure 6:
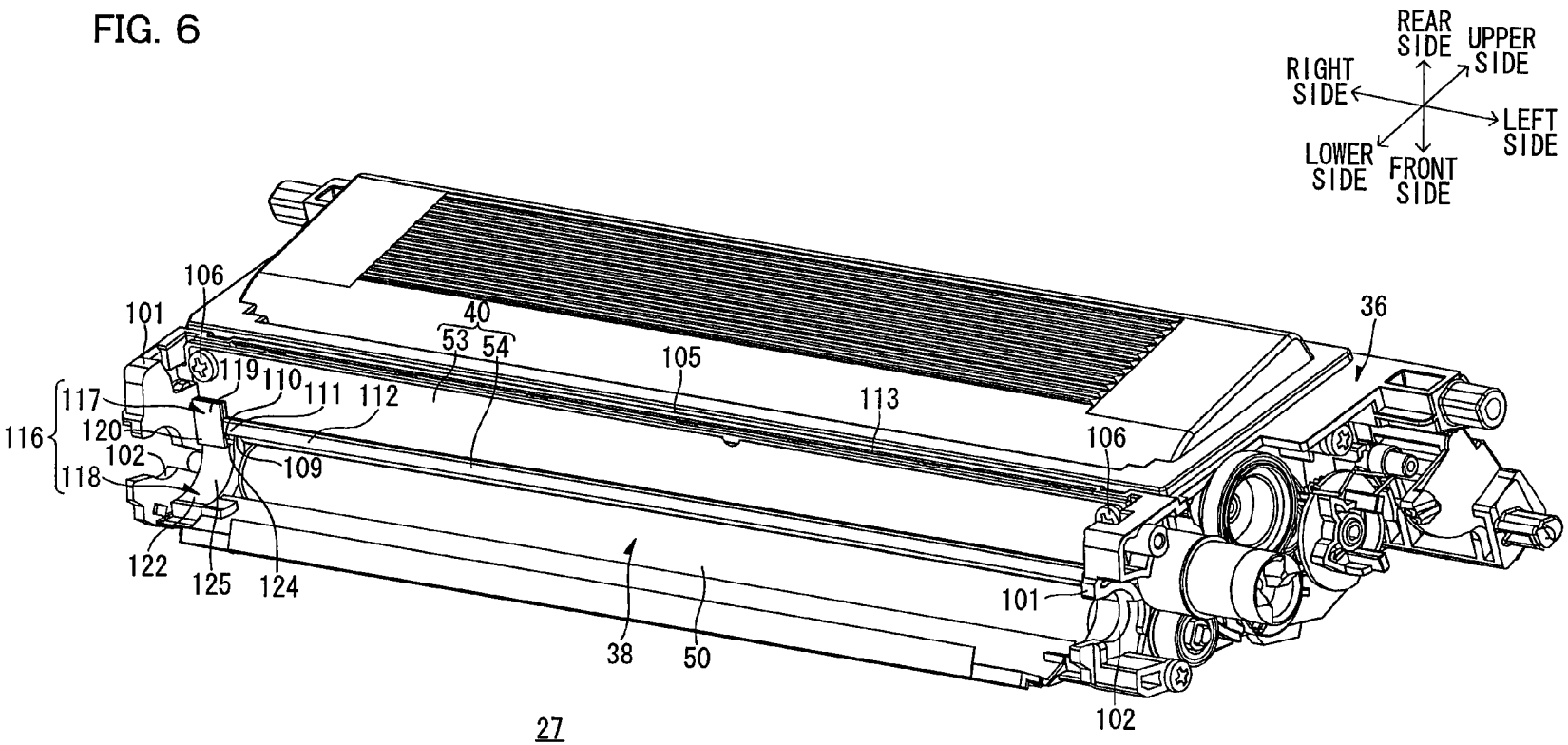
FIG. 6 is a perspective view of the developer cartridge (with the developing roller removed therefrom).
Figure 7:
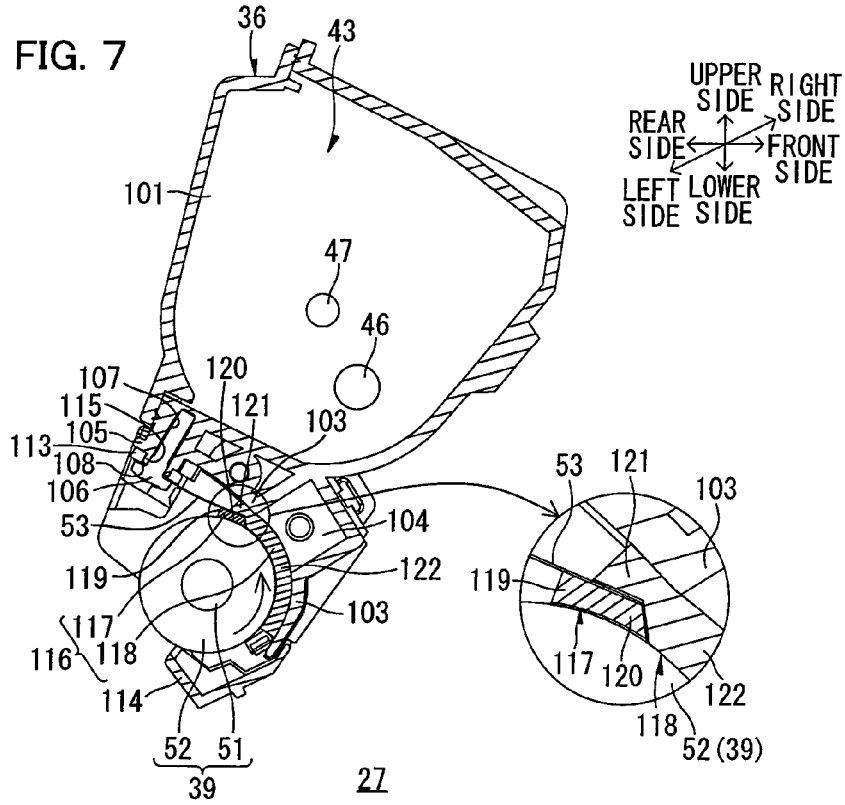
FIG. 7 is a sectional view taken along a line A-A in FIG. 4.
Figure 8:
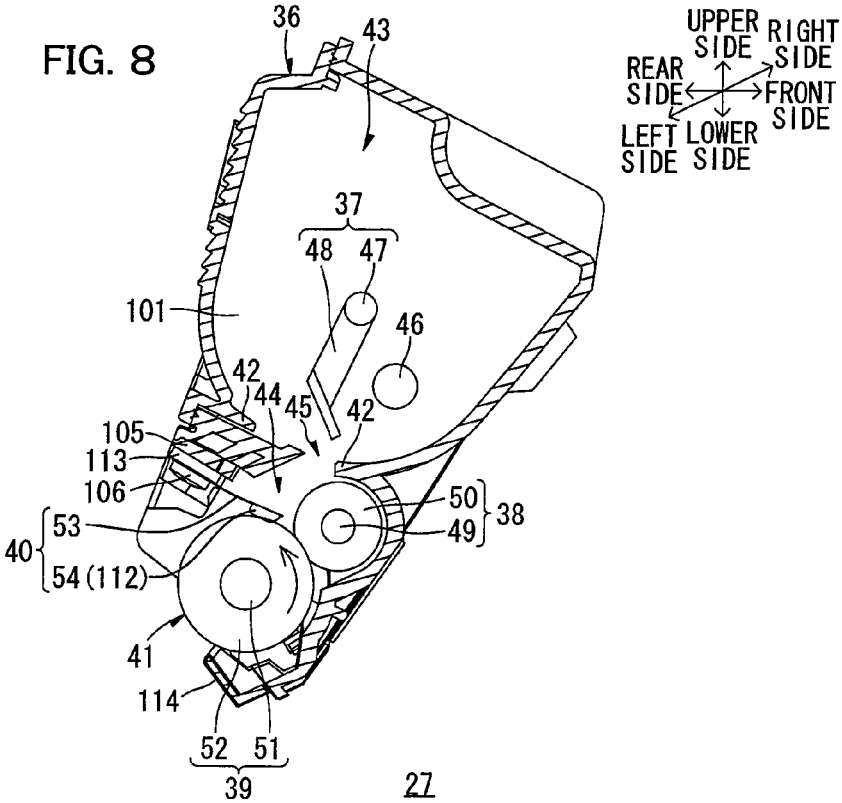
FIG. 8 is a sectional view taken along a line B-B in FIG. 4.
Figure 9:
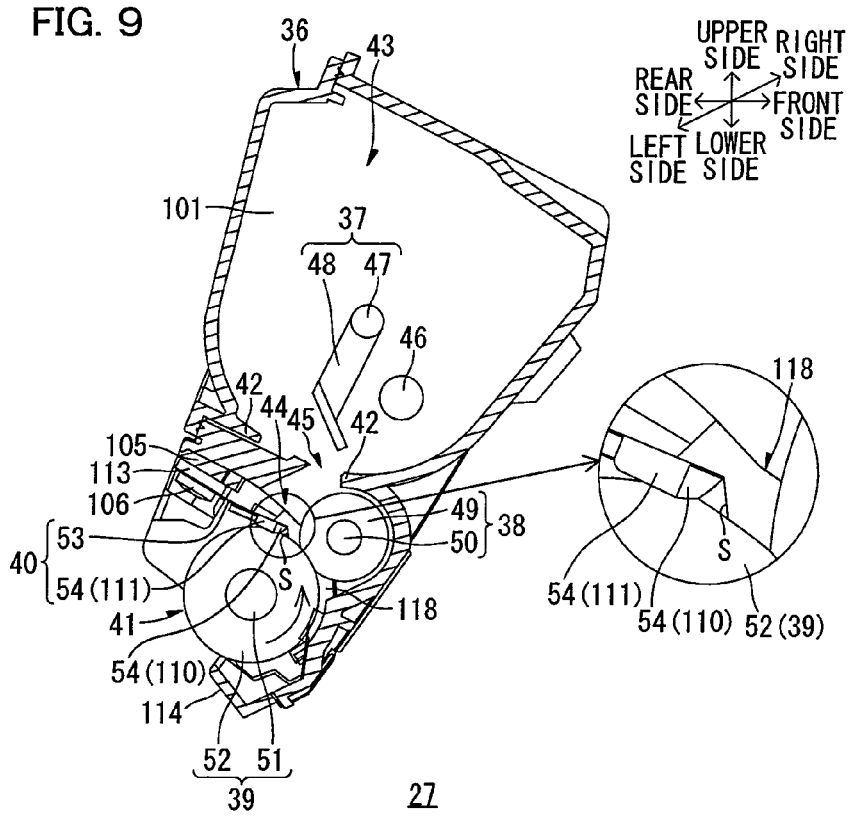
FIG. 9 is a sectional view taken along a line C-C in FIG. 4.
Figure 10:
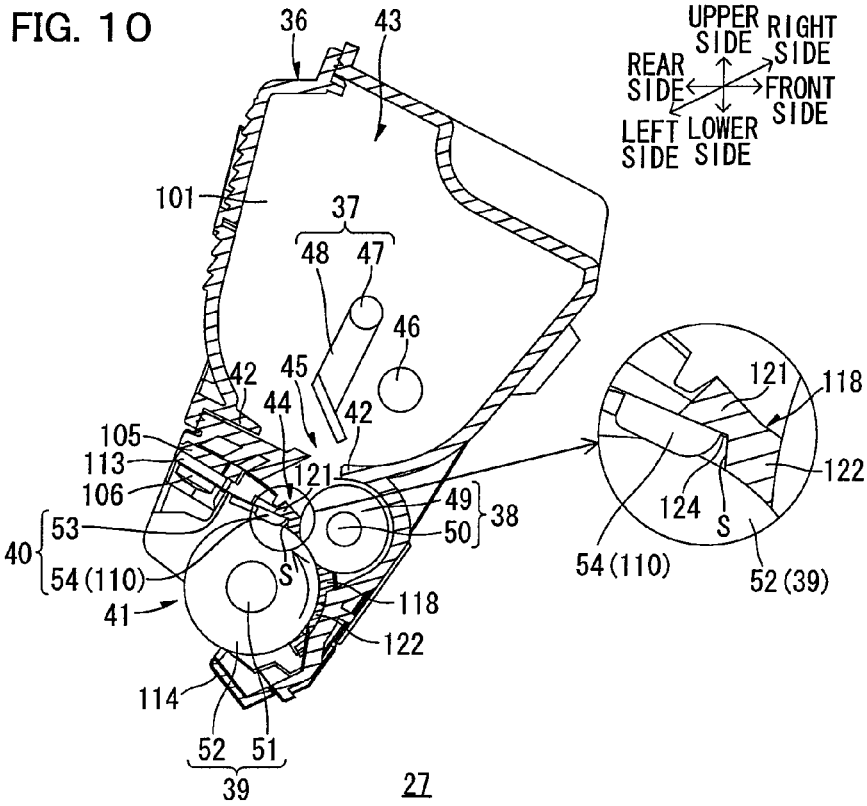
FIG. 10 is a sectional view taken along a line D-D in FIG. 4.
Figure 11:
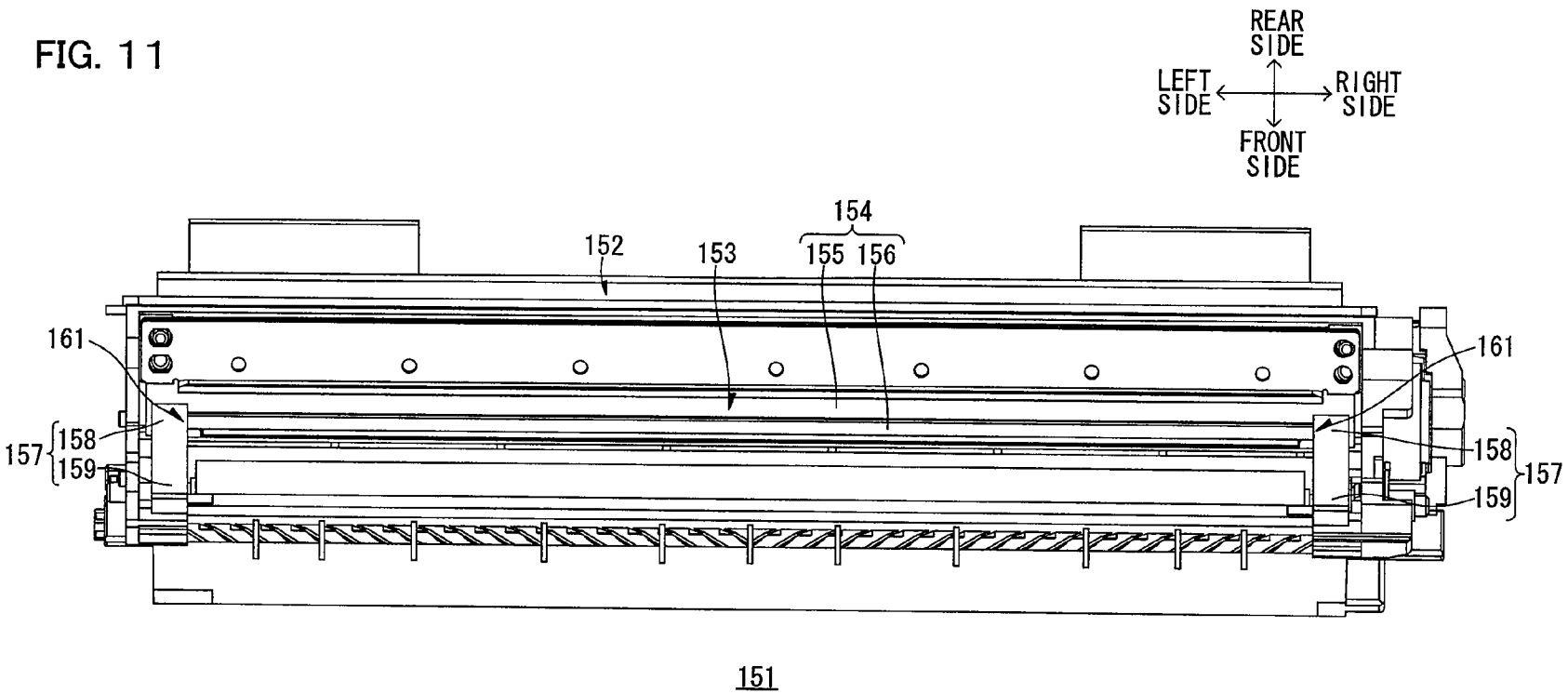
FIG. 11 is a front view of a developer cartridge (with a developing roller removed therefrom).
Figure 12:
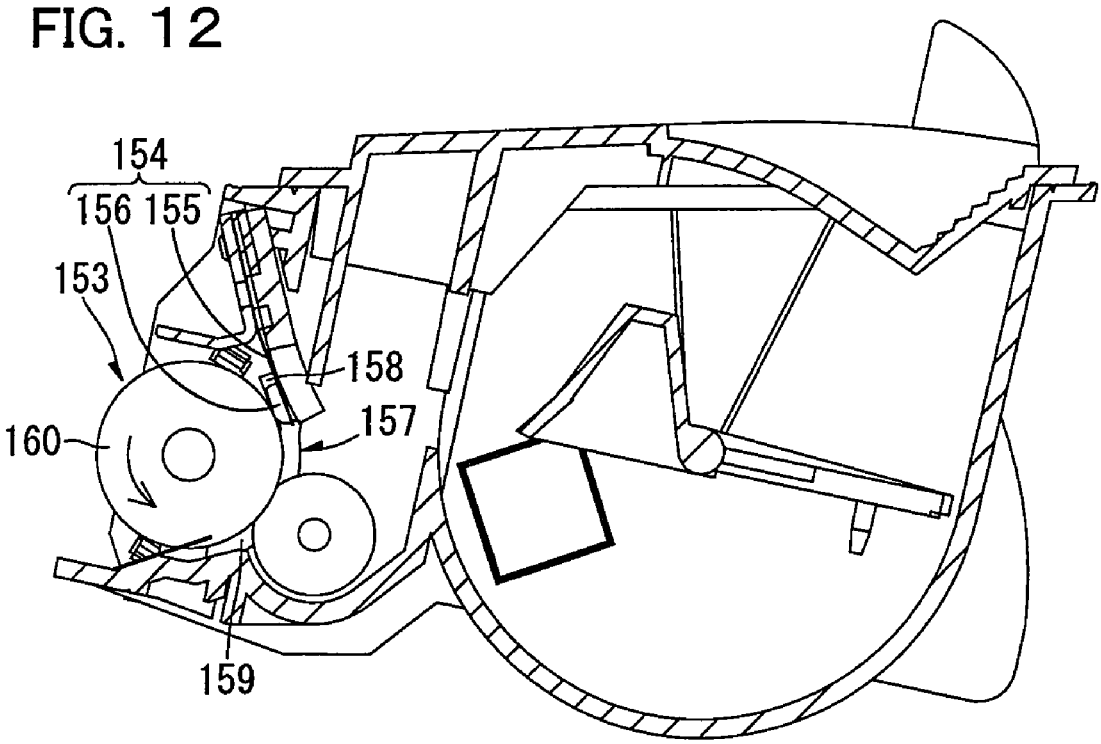
FIG. 12 is a sectional view of the developer cartridge shown in FIG. 11.

FIG. 3 is a perspective view of the developer cartridge, and FIG. 4 is a bottom view of the developer cartridge (with the developing roller attached thereto). FIG. 5 is a bottom view of the developer cartridge (with the developing roller removed therefrom), and FIG. 6 is a perspective view of the developer cartridge (with the developing roller removed therefrom). FIG. 7 is a sectional view taken along a line A-A in FIG. 4, and FIG. 8 is a sectional view taken along a line B-B in FIG. 4. FIG. 9 is a sectional view taken along a line C-C in FIG. 4, and FIG. 10 is a sectional view taken along a line D-D in FIG. 4. The major construction of the developer cartridge 27 will hereinafter be described with reference to FIGS. 3 to 10.

In the following description, the rotation direction of the developing roller 39 is such that a portion of the developing roller 39 initially opposed to the feed roller 38 is brought into opposed relation to the layer-thickness regulating blade 40 and then to the photosensitive drum 29. The terms "upstream" and "downstream" with respect to the rotation direction of the developing roller 39 are herein used to define a positional relationship between two positions along the circumference of the developing roller 39, and the positional relationship is determined so that the two positions are spaced a shorter distance clockwise or counterclockwise circumferentially of the developing roller 39.

2-1. Developer Frame

The developer frame 36 of the developer cartridge 27 is shown in FIG. 3. As described above, the developer frame 36 is of a box shape, and has the opening 41 provided in the lower portion thereof as extending transversely (longitudinally thereof).

As shown in FIGS. 3 and 6, the developer frame 36 has shaft support grooves 102 which are respectively formed in the opposite side walls 101 disposed on transversely opposite sides of the opening 41 by cutting out the portions of the side walls 101 upward from lower ends thereof.

Seal pedestal portions 103 (see FIG. 7) are provided on upper and front peripheral portions of the shaft support grooves 102 on the opposite side walls 101 as projecting transversely inward from the opposite side walls 101.

As shown in FIG. 7, the seal pedestal portions 103 are curved along the outer circumference of the developing roller 39 on the respective side walls 101 as seen from the lateral side. The seal pedestal portions 103 are each divided into a front portion and an upper portion along a periphery thereof by a shaft insertion portion 104 for the feed roller 38.

As shown in FIGS. 6 and 8, the fixing wall 105 on which the layer-thickness regulating blade 40 is fixed is provided along a rear edge of the opening 41 of the developer frame 36.

The fixing wall 105 extends transversely along the rear edge of the opening 41. As shown in FIG. 7, the fixing wall 105 has screw thread holes 107 formed in transversely opposite end portions thereof to be respectively threadingly engaged with the fixing screws 106 to be described later.

As shown in FIGS. 3 and 4, the developer frame 36 further includes receiving members 114 provided below transversely opposite ends of the opening 41 for preventing the toner from falling out of the developer roller 39.

2-2. Layer-Thickness Regulating Blade

As shown in FIGS. 5 and 6 and described above, the layer-thickness regulating blade 40 includes the blade 53 of the leaf spring extending transversely, and the pressure contact rubber 54 of the insulative elastic rubber provided on the free edge portion of the blade 53.

2-2-1. Blade

The blade 53 has a generally rectangular elongated thin plate shape as seen from the bottom side, and extends transversely to positions such as to overlap with side seals 116 (to be described later) provided at the transversely opposite ends of the opening 41.

The blade 53 has screw holes 108 formed in transversely opposite end portions of the proximal edge portion thereof which corresponds to a rear edge portion or a downstream edge portion with respect to the rotation direction of the developing roller 39 that is the same direction as a direction perpendicular to the longitudinal direction of the opening 41 (or transverse directions).

The blade 53 further has notched portions 109 formed in the vicinity of transversely opposite end portions of the free edge portion thereof which corresponds to a front edge portion or an upstream edge portion with respect to the rotation direction of the developing roller 39 that is the same direction as a direction perpendicular to the longitudinal direction of the opening 41 (or to the transverse directions).

The notched portions 109 are respectively located transversely inward of the side seals 116 (to be described later) and spaced a distance X1 (e.g., 0.5 to 1 mm, see an enlarged view of FIG. 5) transversely from the side seals 116 (more specifically, first seal members 117).

The notched portions 109 each have a generally open-square shape recessed rearward or downstream with respect to the rotation direction of the developing roller 39 from a front edge of the blade 53 and opening forward or upstream with respect to the rotation direction of the developing roller 39.

More specifically, the notched portions 109 each have a generally rectangular shape, as seen from the bottom side, which has an outer edge located adjacent to the side seal 116 and spaced the distance X1 transversely inward from the side seal 116, an inner edge spaced a distance X2 (e.g., 3 to 3.5 mm) transversely inward from the outer edge, and a depth D1 (e.g., 1.5 to 2 mm) as measured rearward or downstream with respect to the rotation direction of the developing roller 39 from the front edge of the blade 53 over the distance between the outer edge and the inner edge.

2-2-2. Pressure Contact Rubber

The pressure contact rubber 54 is made of an insulative elastic rubber such as silicone rubber. The pressure contact rubber 54 is provided in the form of a generally rectangular elongated projection, as seen from the bottom side, which extends longitudinally of the opening 41 (or transversely) and projects downward toward the developing roller 39 from the front edge portion of the blade 53 (for example, by 1.5 to 2 mm).

As shown in FIG. 5, the pressure contact rubber 54 integrally includes first pressure contact portions 110 as an example of adjacent portions of a projection member respectively provided transversely outward of the outer edges of the notched portions 109, second pressure contact portions 111 respectively provided rearward or downstream of the notched portions 109 with respect to the rotation direction of the developing roller 39 as continuously extending transversely inward from the first pressure contact portions 110, and a third pressure contact portion 112 provided between the second pressure contact portions 111 as continuously extending transversely inward of the second pressure contact portions 111.

The first pressure contact portions 110 respectively extend transversely outward from the outer edges of the notched portions 109 to portions of the blade 53 transversely inward of transversely opposite ends of the blade 53 on which the first seal members 117 (to be described later) are respectively attached, and each have a width corresponding to the distance X1.

Further, the first pressure contact portions 110 each extend from an upstream edge (front edge) of the blade 53 to a position downstream (rearward) beyond a downstream edge (rear edge) of the notched portion 109 with respect to the rotation direction of the developing roller 39, and each have a length L1 (e.g., 5 to 5.5 mm).

As shown in a D-D sectional view of FIG. 10, the first pressure contact portions 110 each have a generally rectangular sectional shape having round corners as seen in anteroposterior section (taken along the rotation direction of the developing roller 39).

The second pressure contact portions 111 are respectively located rearward or downstream of the notched portions 109 with respect to the rotation direction of the developing roller 39, and each have a width corresponding to the distance X2 between the outer and inner edges of the notched portion 109.

Further, the second pressure contact portions 111 respectively extend from the downstream edges (rear edges) of the notched portions 109 to positions such as to align with downstream edges (rear edges) of the first pressure contact portions 110 in the rotation direction of the developing roller 39.

As shown in a C-C sectional view of FIG. 9, the second pressure contact portions 111 each have a generally rectangular sectional shape having a round corner as seen in anteroposterior section (taken along the rotation direction of the developing roller 39). The second pressure contact portions 111 each have a smaller anteroposterior length in section (as measured along the rotation direction of the developing roller 39) than the first pressure contact portions 110.

The third pressure contact portion 112 extends transversely continuously from the second pressure contact portions 111 between the transversely inner edges of the second pressure contact portions 111.

Further, the third pressure contact portion 112 extends from the upstream edge (front edge) of the blade 53 to a position such as to align with downstream edges (rear edges) of the second pressure contact portions 111 in the rotation direction of the developing roller 39.

As shown in a B-B sectional view of FIG. 8, the third pressure contact portion 112 has a generally rectangular sectional shape as seen in anteroposterior section (taken along the rotation direction of the developing roller 39). The third pressure contact portion 112 has substantially the same anteroposterior length in section as the first pressure contact portions 110 (as measured along the rotation direction of the developing roller 39).

That is, the first pressure contact portions 110, the second pressure contact portions 111 and the third pressure contact portion 112 of the pressure contact rubber 54 are transversely continuously arranged. The rear edges of the first pressure contact portions 110, the second pressure contact portions 111 and the third pressure contact portion 112 are aligned transversely with each other at the same position with respect to the rotation direction of the developing roller 39. Further, the front edge of the third pressure contact portion 112 is located at substantially the same position with respect to the rotation direction of the developing roller 39 as the front edges of the first pressure contact portions 110, and the front edges of the second pressure contact portions 111 are located rearward or downstream of the front edges of the first pressure contact portions 110.

The pressure contact rubber 54 substantially surrounds the notched portions 109. More specifically, the first pressure contact portions 110 are continuous from the second pressure contact portions 111 to surround the transversely outer edges of the respective notched portions 109, and the third pressure contact portion 112 is continuous from the second pressure contact portions 111 to surround the transversely inner edges of the respective notched portions 109.

2-2-3. Fixing of Layer-Thickness Regulating Blade

As shown in FIGS. 5 and 7, the layer-thickness regulating blade 40 is fixed together with a support plate 113 to the fixing wall 105 of the developer frame 36 by the fixing screws 106.

The support plate 113 is made of a steel plate, and has a generally rectangular elongated shape having the same length as the blade 53 as seen from the bottom side. The support plate 113 has screw holes 115 respectively formed in transversely opposite end portions thereof as aligning with the screw holes 108 of the blade 53.

The support plate 113 is attached to an upper surface of the blade 53 by a two-sided adhesive tape.

The layer-thickness regulating blade 40 is fixed to the fixing wall 105 by bringing the support plate 113 into contact with the fixing wall 105 in opposed relation to the fixing wall 105, inserting the fixing screws 106 into the screw holes 108 of the blade 53 and the screw holes 115 of the support plate 113, and threadingly engaging the fixing screws 106 with the screw thread holes 107 of the fixing wall 105.

Thus, the proximal edge portion (rear edge portion) of the blade 53 is fixed to the fixing wall 105, while the pressure contact rubber 54 provided on the free edge portion (front edge portion) of the blade 53 is opposed to the developing roller 39 in pressure contact with the developing roller 39 from above by the elastic force of the blade 53. The transversely opposite ends of the blade 53 are respectively opposed to the seal pedestal portions 103 of the developer frame 2-3. Side Seals As shown in FIGS. 5 and 6, the side seals 116 as an example of leak preventing member are provided at the longitudinally opposite ends of the opening 41 of the developer frame 36 for preventing the toner carried on the developing roller 39 from leaking out of the developer frame 36 through axially opposite ends of the developing roller 39.

The side seals 116 are thick strip-like sheets (e.g., having a thickness of 3 to 4 mm) as seen from the bottom side. The side seals 116 are each made of an elastic foam material such as a urethane sponge, more specifically a high-density micro-cell urethane foam (available from Rogers Inoac Corporation under the trade name of PORON). The high-density micro-cell urethane foam has a hardness of 0.001 to 0.05 MPa, more preferably 0.005 to 0.025 MPa, under a 25% compression load. A felt member such as of Teflon (registered trade mark) felt is attached to a surface (opposed to the developing roller 39) of the elastic foam material for improving the slidability.

The side seals 116 each include a first seal member 117 and a second seal member 118 which are arranged along the rotation direction of the developing roller 39.

2-3-1. First Seal Member

The first seal member 117 is of a generally rectangular shape as seen from the bottom side, and has a width W1 (transverse dimension) which corresponds to a transverse distance (e.g., 5.5 to 6 mm) between the transversely outer end of the blade 53 and the transversely outer edge of the first pressure contact portion 110.

The first seal member 117 has a first downstream portion (rear portion) 119 located downstream with respect to the rotation direction of the developing roller 36. The first downstream portion 119 is attached to a lower surface (opposed to the developing roller 39) of the transversely outer end portion of the blade 53 (between the transversely outer edge of the blade 53 and the transversely outer edge of the first pressure portion 110) by a two-sided adhesive tape (see FIG. 7).

The first downstream portion 119 is located transversely outward of the first pressure contact portion 110 in adjoining relation, and extends from the front edge of the blade 53 to the rear side of the rear edge of the first pressure contact portion 110 in the rotation direction of the developing roller 39.

The first seal member 117 further has a first upstream portion (front portion) 120 located upstream with respect to the rotation direction of the developing roller 36. The first upstream portion 120 extends forward or upstream with respect to the rotation direction of the developing roller 36 continuously from the first downward portion 119. The first upstream portion 120 covers a lower surface of a covered portion 123 of the second seal member 118 to be described later.

2-3-2. Second Seal Member

The second seal member 118 is of a generally rectangular shape as seen from the bottom side, and has a width W2 (transverse dimension) corresponding to a transverse distance (e.g., 9 to 10 mm) between the transversely outer edge of the blade 53 and the transversely outer edge of the notched portion 109.

As shown in FIG. 7, the second seal member 118 is attached to the front portion and the upper portion of the seal pedestal portion 103 of the developer frame 36 by two-sided adhesive tapes.

More specifically, the second seal member 118 has a second downstream portion (upper edge portion) 121 located downstream with respect to the rotation direction of the developer roller 36. The second downstream portion 121 is disposed on the transversely outer end portion of the blade 53 (between the transversely outer end of the blade 53 and the transversely outer edge of the notched portion 109). The second downstream portion 121 is held between the upper portion of the seal pedestal portion 103 and an upper surface of the blade 53 (opposite from the opposed surface of the developing roller 39), and attached to the upper portion of the seal pedestal portion 103 and the upper surface of the blade 53 by two-sided adhesive tapes.

As shown in FIGS. 5 and 7, the second downstream portion 121 is opposed to the first downstream portion 119 of the first seal member 117 with the intervention of the blade 53. As shown in FIGS. 5 and 10, the second downstream portion 121 is also opposed to the first pressure contact portion 110 with the intervention of the blade 53.

As shown in FIGS. 5 and 7, the second seal member 118 further has a second upstream portion 122 (which corresponds to an upper end portion thereof except for the upper edge portion (second downstream portion 121) and a front portion thereof) located upstream with respect to the rotation direction of the developing roller 36. The second upstream portion 122 extends forward or upstream with respect to the rotation direction of the developing roller 36 continuously from the second downstream portion 121. The second upstream portion 122 is attached to the front portion of the seal pedestal portion 103 of the developer frame 36 by a two-sided adhesive tape.

The second upstream portion 122 includes the covered portion 123, an opposed portion 124 and an exposed portion 125 as shown in FIG. 5.

The covered portion 123 is defined as a downstream portion (rear portion) of the second upstream portion 122 located downstream with respect to the rotation direction of the developing roller 36 and transversely outward. As described above, the covered portion 123 is covered with the first upstream portion 120.

The covered portion 123 has a dimension L2 of 0.5 to 1 mm as measured in the rotation direction of the developing roller 39.

The opposed portion 124 is defined as a downstream portion (rear portion) of the second upstream portion 122 located downstream with respect to the rotation direction of the developing roller 39 and transversely inward of the covered portion 123 in transversely adjoining relation.

The opposed portion 124 is located adjacent the first upstream portion 120 covering the covered portion 123 on the transversely outer side, and located adjacent the first pressure contact portion 110 on the upstream side (front side) with respect to the rotation direction of the developing roller 39 in opposed relation.

That is, the opposed portion 124 is surrounded by the first upstream portion 120 on the transversely outer side, and by the first pressure contact portion 110 on the rear side. Level differences are present between the opposed portion 124 and the first upstream portion 120 and between the opposed portion 124 and the first pressure contact portion 110. That is, the opposed portion 124, which is surrounded by the first upstream portion 120 on the transversely outer side and by the first pressure contact portion 110 on the rear side, is recessed from the first upstream portion 120 and the first pressure contact portion 110.

The exposed portion 125 is defined as an upstream portion (front portion) of the second upstream portion 122 located upstream of the covered portion 123 and the opposed portion 124 with respect to the rotation direction of the developing roller 36. As shown in FIG. 7, the exposed portion 125 is attached to the front portion of the seal pedestal portion 103 of the developer frame 36 by a two-sided adhesive tape.

2-4. Developing Roller

As shown in FIGS. 3 and 6, the axially opposite ends of the developing roller shaft 51 of the developing roller 39 are received in the shaft support grooves 102 formed in the opposite side walls 101 of the developer frame 36, whereby the developing roller 39 is rotatably supported by the opposite side walls 101 of the developer frame 36.

With the developing roller 39 supported by the opposite side walls 101, the exposed portions 125 of the second seal members 118 are pressed to a thickness of not greater than two thirds of the original thickness thereof (which is measured in an unpressed state) by the transversely opposite end portions of the developing roller 39 (see FIG. 7).

Further, the rubber roller 52 of the developing roller 39 is pressed across its width by the pressure contact rubber 54 as shown in FIG. 8.

As shown in FIG. 10, there is a small gap S between each of the opposed portions 124 of the second seal members 118 and the rubber roller 52. The gap S is defined by the opposed portion 124, the rubber roller 52 and the first pressure contact portion 110 in a section perpendicular to the transverse directions (or the longitudinal axis of the opening 41), i.e., perpendicular to the axis of the developing roller 39. More specifically, the gap S has an area of 0.2 to 0.7 $mm^2$ in the section perpendicular to the axis of the developing roller 39.

3. Effects of First Embodiment (1) As described above, the side seals 116 of the developer cartridge 27 each include the first seal member 117 and the second seal member 118.

The first downstream portion 119 of the first seal member 117 is located adjacent the first pressure contact portion 110 on the lower surface of the blade 53, and the second downstream portion 121 of the second seal member 118 is located on the upper surface of the blade 53 in opposed relation to the first downstream portion 119 and the first pressure contact portion 110 with the intervention of the blade 53.

Further, the second upstream portion 122 continuous from the second downstream portion 121 integrally includes the covered portion 123 which is covered by the first upstream portion 120, the opposed portion 124 which is disposed adjacent the covered portion 123 on the transversely inward side and opposed to the first pressure contact portion 110 on the upstream side with respect to the developing roller 39, and the exposed portion 125 which extends upstream with respect to the rotation direction of the developing roller 39 from the covered portion 123 and the opposed portion 124.

The opposed portion 124 is disposed adjacent the first upstream portion 120 covering the covered portion 123 on the transversely outer side, and disposed adjacent the first pressure contact portion 110 on the upstream side (front side) with respect to the rotation direction of the developing roller 39. Therefore, the level differences are present between the opposed portion 124 and the first upstream portion 120 and between the opposed portion 124 and the first pressure contact portion 110.

That is, the opposed portion 124 is surrounded by the first upstream portion 120 on the transversely outer side and by the first pressure contact portion 110 on the rear side with the level differences and, therefore, recessed from the first upstream portion 120 and the first pressure contact portion 110.

Therefore, the gaps S are formed between the opposed portions 124 and the rubber roller 52 of the developing roller 39 even with the developing roller 39 kept in pressure contact with the surfaces of the side seals 116.

When the developing roller 39 is rotated for the development, toner intruding into the gaps S of the opposed portions 124 would be liable to further intrude into boundary portions between the first seal members 117 and the first pressure contact portions 110 along the rotation direction of the developing roller 39. However, the level differences between the opposed portions 124 and the first pressure contact portions 110 blocked the intrusion. Since the toner sequentially enters the gaps S of the opposed portions 124, the toner blocked from intruding into the boundary portions is released transversely inward from the gaps S due to the further entering toner. That is, the toner entering the gaps S of the opposed portions 124 on the transversely opposite end portions of the developing roller 39 is circulated in the gaps S, and released inward of the transversely opposite end portions of the developing roller 39 from the gaps S.

As a result, the leak of the toner from the boundary portions between the side seals 116 and the pressure contact rubber 54 is effectively prevented with the simple construction.

(2) As described above, the gaps S of the opposed portions 124 each have an area of 0.2 to 0.7 $mm^2$ in the section perpendicular to the transverse directions. Therefore, the toner is assuredly circulated in the gaps S of the opposed portions 124. As a result, the leak of the toner from the boundary portions between the side seals 116 and the pressure contact rubber 54 is more reliably prevented.

Table 1 shows the results of evaluation of developer cartridges which vary in the areas of the gaps S of the opposed portions 124. The evaluation is based on three evaluation tests, i.e., a toner intrusion test for checking for the intrusion of the toner into the boundary portions between the first seal members 117 and the first pressure contact portions 110, an impact test and a drop test.

TABLE 1

| | Gaps S ($mm^2$) | | | |
|---|---|---|---|---|
| | 0.2 | 0.3 | 0.5 | 0.7 |
| Intrusion into boundary portions between first seal members and first pressure contact members*1 | ○ | ○ | ○ | Δ |
| Impact test*2 | ○ | ○ | ○ | x |
| Drop test*3 | Δ | ○ | ○ | x |

*1A symbol ○ indicates that the toner did not intrude.
A symbol Δ indicates that the toner intruded to some extent.
*2A symbol ○ indicates that the toner did not intrude into the boundary portions between the first seal members and the first pressure contact members.
A symbol x indicates that the toner passed through the boundary portions between the first seal members and the first pressure contact members.
*3A symbol ○ indicates that the toner did not intrude into the boundary portions between the first seal members and the first pressure contact members.
A symbol Δ indicates that the toner intruded into the boundary portions between the first seal members and the first pressure contact members to some extent.
A symbol x indicates that the toner passed through the boundary portions between the first seal members and the first pressure contact members.

In the toner intrusion test for checking for the intrusion of the toner into the boundary portions between the first seal members 117 and the first pressure contact portions 110, the developer roller 39 of a new developer cartridge 27 was rotated at a rotation speed of 20 ppm for 10 hours in a warm-up mode, and then a testing operator visually checked the developer cartridge for the intrusion of the toner for the evaluation. Here, "Warm-up mode" means that the developer roller 39 is rotated with no sheet being fed thereto.

More specifically, the testing operator pulled the first seal member 117 attached to the blade 53 away from the first pressure contact portion 110 to expand the boundary portion between the first seal member 117 and the first pressure contact portion 110, and then visually checked whether or not the toner intruded into the boundary portion between the first seal member 117 and the first pressure contact portion 110.

The evaluation was based on the following criteria which are expressed by the symbols o, Δ and x. The symbol o indicates that the toner did not intrude into the boundary portion at all, and the symbol Δ indicates that the toner intruded into the boundary portion to some extent. The symbol x indicates that the toner passed through the boundary portion.

In the impact test, the developer cartridge 27 was tapped down on a table six times so as to bring the developing roller 39 thereof into contact with the table, and then the toner intrusion test was performed in the aforesaid manner to check for the leak of the toner from the developer cartridge 27. More specifically, the expression "the developer cartridge 27 was tapped down on a table" means that the developer cartridge 27 which has a weight of 620 g was freely dropped onto a surface of a hard iron table.

In the drop test, the 620 g developer cartridge 27 was freely dropped from a height of 30 cm above the hard iron table so as to cause the developing roller 39 to collide with the surface of the table, and then the toner intrusion test was performed in the aforesaid manner to check for the leak of the toner from the developer cartridge 27.

As can be understood from Table 1, the leak of the toner is effectively prevented with the provision of gaps S each having an area of 0.2 to 0.7 $mm^2$. Here, the area of each of the gaps S was varied by changing the attaching position of the first seal member 117 with respect to the blade 53.

(3) The bland 53 has the notched portions 109 respectively provided transversely inward of the first pressure contact portions 110. Therefore, the toner circulated in the gaps S of the opposed portions 124 and released inward of the transversely opposite end portions of the developing roller 39 is received in the notched portions 109, so that the flow of the toner is facilitated. As a result, the leak of the toner is more reliably prevented.

(4) The notched portions 109 are respectively spaced the distance X1 transversely from the first seal members 117. Therefore, the toner circulated in the gaps S of the opposed portions 124 and released inward of the transversely opposite end portions of the developing roller 39 flows further inward, and is received in the notched portions 109. As a result, the toner is more reliably prevented from stagnating on the transversely opposite end portions of the developing roller 39.

(5) In the developer cartridge 27, the exposed portions 125 of the respective second seal members 118 are pressed to a thickness of not greater than two thirds of the original thickness (which is measured in an unpressed state) by the transversely opposite end portions of the developing roller 39. This prevents formation of gaps between the exposed portions 125 of the second seal members 118 and the transversely opposite end portions of the developing roller 39. As a result, the leak of the toner from the boundary portions between the exposed portions 125 of the second seal members 118 and the transversely opposite end portions of the developing roller 39 is prevented.

(6) The toner contained in the toner accommodating chamber 43 of the developer cartridge 27 has an average particle diameter of not greater than 10 μm, so that the toner would be liable to leak through the boundary portions between the side seals 116 and the pressure contact rubber 54. However, the leak of the toner is effectively prevented with the aforesaid simple construction.

(7) The toner contained in the toner accommodating chamber 43 of the developer cartridge 27 has a sphericity of not smaller than 0.95 and hence excellent fluidity. This facilitates the circulation of the toner in the gaps S of the opposed portions 124. Therefore, the leak of the toner is more effectively prevented.

(8) In the drum unit 25 and the laser printer 1 each including such a developer cartridge 27, the leak of the toner is effectively prevented.

Second Embodiment

In the foregoing description, the tandem color laser printer is employed as the image forming apparatus by way of example. However, the image forming apparatus in which the inventive developing device (developer cartridge) is mounted is not limited to the aforementioned one. Other examples of the image forming apparatus include a color laser printer of an intermediate transfer type in which color developing agent images are once transferred onto an intermediate transfer member from respective image carriers and then transferred onto a recording medium, and a monochrome laser printer.

Examples of the monochrome laser printer include a monochrome laser printer (image forming apparatus) including a fixing unit (fixing section) and an image carrier device (drum unit) which is detachably mounted therein and includes an image carrier (photosensitive drum) and the inventive developing device (developer cartridge) detachably mounted in the image carrier device, and a monochrome laser printer (image forming apparatus) including an image carrier (photosensitive drum), a fixing unit (fixing section) and the inventive developing device (developer cartridge) detachably mounted therein.

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. A developing device comprising:

a casing which contains a developing agent and has an opening extending longitudinally thereof;

a developing agent carrier rotatably provided in the casing as being exposed from the opening and carrying the developing agent;

leak preventing members disposed at longitudinally opposite ends of the opening for preventing the developing agent from leaking out of the casing; and a layer-thickness regulating member kept in pressure contact with a surface of the developing agent carrier for forming a thin layer of the developing agent on the surface of the developing agent carrier, wherein the layer-thickness regulating member includes:

a thin plate member having a thin plate shape extending longitudinally of the casing to positions such as to overlap with the leak preventing members, and having a downstream edge portion fixed to the casing with respect to a direction of rotation of the developing agent carrier that is the same direction as a direction perpendicular to a longitudinal direction of the casing and a free upstream edge portion with respect to the rotation direction; and a projection member provided on the free edge portion of the thin plate member as extending longitudinally of the casing and projecting toward the developing agent carrier, wherein the leak preventing members each include a first seal member and a second seal member each disposed along the rotation direction, wherein the first seal member includes:

a first downstream portion disposed adjacent, longitudinally of the casing, to the projection member on a front surface of the thin plate member opposed to the developing agent carrier; and a first upstream portion extending upstream of the first downstream portion with respect to the rotation direction continuously from the first downstream portion, wherein the second seal member includes:

a second downstream portion disposed on a rear surface of the thin plate member facing away from the developing agent carrier, the second downstream portion being opposed to the first downstream portion and a portion of the projection member adjacent to the first downstream portion with intervention of the thin plate member; and a second upstream portion which extends upstream of the second downstream portion with respect to the rotation direction continuously from the second downstream portion, and integrally includes a covered portion covered with the first upstream portion, an opposed portion disposed adjacent, longitudinally of the casing, to the covered portion and opposed to the projection member in the rotation direction, and an exposed portion extending upstream of the covered portion and the opposed portion with respect to the rotation direction.

2. A developing device according to claim 1, wherein a gap having an area of 0.2 to 0.7 $mm^2$ in section perpendicular to the longitudinal direction is defined between the opposed portion of the second upstream portion of the second seal member and the developing agent carrier.

3. A developing device according to claim 1, wherein the thin plate member has notched portions each extending downstream with respect to the rotation direction from an edge of the free edge portion on a side of the projection member longitudinally opposite from the first downstream portion in longitudinally spaced relation from the first seal member.

4. A developing device according to claim 1, wherein the exposed portion of the second seal member is pressed to a thickness of not greater than two thirds of an original thickness thereof measured in an unpressed state by longitudinally opposite end portions of the developing agent carrier.

5. A developing device according to claim 1, wherein the developing agent has an average particle diameter of not greater than 10 μm.

6. A developing device according to claim 1, wherein the developing agent has a sphericity of not less than 0.95.

7. An image carrier device comprising:

a developing device; and an image carrier which carries a developing agent image formed thereon by supplying a developing agent thereto from the developing device and developing an electrostatic latent image with the developing agent, wherein the developing device includes:

a casing which contains the developing agent to be supplied to the image carrier and has an opening extending longitudinally thereof;

a developing agent carrier rotatably provided in the casing as being exposed from the opening and carrying the developing agent to be supplied to the image carrier;

leak preventing members disposed at longitudinally opposite ends of the opening for preventing the developing agent from leaking out of the casing; and a layer-thickness regulating member kept in pressure contact with a surface of the developing agent carrier for forming a thin layer of the developing agent on the surface of the developing agent carrier, wherein the layer-thickness regulating member includes:

a thin plate member having a thin plate shape extending longitudinally of the casing to positions such as to overlap with the leak preventing members, and having a downstream edge portion fixed to the casing with respect to a direction of rotation of the developing agent carrier that is the same direction as a direction perpendicular to a longitudinal direction of the casing and a free upstream edge portion with respect to the rotation direction; and a projection member provided on the free edge portion of the thin plate member as extending longitudinally of the casing and projecting toward the developing agent carrier, wherein the leak preventing members each include a first seal member and a second seal member each disposed along the rotation direction, wherein the first seal member includes:

a first downstream portion disposed adjacent, longitudinally of the casing, to the projection member on a front surface of the thin plate member opposed to the developing agent carrier; and a first upstream portion extending upstream of the first downstream portion with respect to the rotation direction continuously from the first downstream portion, wherein the second seal member includes:

a second downstream portion disposed on a rear surface of the thin plate member facing away from the developing agent carrier, the second downstream portion being opposed to the first downstream portion and a portion of the projection member adjacent to the first downstream portion with intervention of the thin plate member; and a second upstream portion which extends upstream of the second downstream portion with respect to the rotation direction continuously from the second downstream portion and integrally includes a covered portion covered with the first upstream portion, an opposed portion disposed adjacent, longitudinally of the casing, to the covered portion and opposed to the projection member in the rotation direction, and an exposed portion extending upstream of the covered portion and the opposed portion with respect to the rotation direction.

8. An image forming apparatus comprising:

an image carrier device; and a fixing unit which fixes a developing agent image carried by the image carrier device on a recording medium, wherein the image carrier device includes:

a developing device; and an image carrier which carries a developing agent image formed thereon by supplying a developing agent thereto from the developing device and developing an electrostatic latent image with the developing agent, wherein the developing device includes:

a casing which contains the developing agent to be supplied to the image carrier and has an opening extending longitudinally thereof;

a developing agent carrier rotatably provided in the casing as being exposed from the opening and carrying the developing agent to be supplied to the image carrier;

leak preventing members disposed at longitudinally opposite ends of the opening for preventing the developing agent from leaking out of the casing; and a layer-thickness regulating member kept in pressure contact with a surface of the developing agent carrier for forming a thin layer of the developing agent on the surface of the developing agent carrier, wherein the layer-thickness regulating member includes:

a thin plate member having a thin plate shape extending longitudinally of the casing to positions such as to overlap with the leak preventing members, and having a downstream edge portion fixed to the casing with respect to a direction of rotation of the developing agent carrier that is the same direction as a direction perpendicular to a longitudinal direction of the casing and a free upstream edge portion with respect to the rotation direction; and a projection member provided on the free edge portion of the thin plate member as extending longitudinally of the casing and projecting toward the developing agent carrier, wherein the leak preventing members each include a first seal member and a second seal member each disposed along the rotation direction, wherein the first seal member includes:

a first downstream portion disposed adjacent, longitudinally of the casing, to the projection member on a front surface of the thin plate member opposed to the developing agent carrier; and a first upstream portion extending upstream of the first downstream portion with respect to the rotation direction continuously from the first downstream portion, wherein the second seal member includes:

a second downstream portion disposed on a rear surface of the thin plate member facing away from the developing agent carrier, the second downstream portion being opposed to the first downstream portion and a portion of the projection member adjacent to the first downstream portion with intervention of the thin plate member; and a second upstream portion which extends upstream of the second downstream portion with respect to the rotation direction continuously from the second downstream portion and integrally includes a covered portion covered with the first upstream portion, an opposed portion disposed adjacent, longitudinally of the casing, to the covered portion and opposed to the projection member in the rotation direction, and an exposed portion extending upstream of the covered portion and the opposed portion with respect to the rotation direction.

9. An image forming apparatus comprising:

a developing device;

an image carrier which carries a developing agent image formed thereon by supplying a developing agent thereto from the developing device and developing an electrostatic latent image with the developing agent; and a fixing unit which fixes the developing agent image carried by the image carrier on a recording medium, wherein the developing device includes:

a casing which contains the developing agent to be supplied to the image carrier and has an opening extending longitudinally thereof;

a developing agent carrier rotatably provided in the casing as being exposed from the opening and carrying the developing agent to be supplied to the image carrier;

leak preventing members disposed at longitudinally opposite ends of the opening for preventing the developing agent from leaking out of the casing; and a layer-thickness regulating member kept in pressure contact with a surface of the developing agent carrier for forming a thin layer of the developing agent on the surface of the developing agent carrier, wherein the layer-thickness regulating member includes:

a thin plate member having a thin plate shape extending longitudinally of the casing to positions such as to overlap with the leak preventing members, and having a downstream edge portion fixed to the casing with respect to a direction of rotation of the developing agent carrier that is the same direction as a direction perpendicular to a longitudinal direction of the casing and a free upstream edge portion with respect to the rotation direction; and a projection member provided on the free edge portion of the thin plate member as extending longitudinally of the casing and projecting toward the developing agent carrier, wherein the leak preventing members each include a first seal member and a second seal member each disposed along the rotation direction, wherein the first seal member includes:

a first downstream portion disposed adjacent, longitudinally of the casing, to the projection member on a front surface of the thin plate member opposed to the developing agent carrier; and a first upstream portion extending upstream of the first downstream portion with respect to the rotation direction continuously from the first downstream portion, wherein the second seal member includes:

a second downstream portion disposed on a rear surface of the thin plate member facing away from the developing agent carrier, the second downstream portion being opposed to the first downstream portion and a portion of the projection member adjacent to the first downstream portion with intervention of the thin plate member; and a second upstream portion which extends upstream of the second downstream portion with respect to the rotation direction continuously from the second downstream portion and integrally includes a covered portion covered with the first upstream portion, an opposed portion disposed adjacent, longitudinally of the casing, to the covered portion and opposed to the projection member in the rotation direction, and an exposed portion extending upstream of the covered portion and the opposed portion with respect to the rotation direction.

* * * * *